US012534161B2

(12) United States Patent
Miwa

(10) Patent No.: US 12,534,161 B2
(45) Date of Patent: Jan. 27, 2026

(54) SPONSON DEVICE AND JET PROPELLED WATERCRAFT

(71) Applicant: YAMAHA HATSUDOKI KABUSHIKI KAISHA, Iwata (JP)

(72) Inventor: Junya Miwa, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 415 days.

(21) Appl. No.: 18/219,742

(22) Filed: Jul. 10, 2023

(65) Prior Publication Data

US 2024/0017795 A1 Jan. 18, 2024

(30) Foreign Application Priority Data

Jul. 15, 2022 (JP) ..... 2022-114011

(51) Int. Cl.

| | |
|---|---|
| ***B63B 1/28*** | (2006.01) |
| ***B63B 1/24*** | (2020.01) |
| ***B63B 1/26*** | (2006.01) |
| ***B63B 34/10*** | (2020.01) |

(52) U.S. Cl.

CPC ..... *B63B 1/285* (2013.01); *B63B 1/242* (2013.01); *B63B 1/26* (2013.01); *B63B 34/10* (2020.02)

(58) Field of Classification Search

CPC ..... B63B 1/285; B63B 1/242; B63B 1/26; B63B 34/10

See application file for complete search history.

(56) References Cited

U.S. PATENT DOCUMENTS

| | | | | |
|---|---|---|---|---|
| 5,544,607 | A * | 8/1996 | Rorabaugh | B60F 3/0046 114/274 |
| 6,712,016 | B1 * | 3/2004 | Morisch | B63B 1/18 114/284 |
| 7,185,599 | B1 * | 3/2007 | Griffiths | B63B 1/12 114/263 |
| 2004/0168623 | A1 * | 9/2004 | Kirk | B63B 34/10 114/55.57 |

FOREIGN PATENT DOCUMENTS

| | | | | |
|---|---|---|---|---|
| JP | 2001233288 | A * | 8/2001 | B63B 39/06 |

* cited by examiner

*Primary Examiner* — S. Joseph Morano
*Assistant Examiner* — Jovon E Hayes
(74) *Attorney, Agent, or Firm* — Keating & Bennett, LLP

(57) ABSTRACT

A sponson device attachable to a watercraft body of a jet propelled watercraft includes a bow sponson located forward of a center of gravity of the jet propelled watercraft. The bow sponson protrudes from the watercraft body in a right-and-left direction, and is movable to a first position and a second position to adjust a trim of the watercraft body during turning of the jet propelled watercraft.

12 Claims, 6 Drawing Sheets

SPONSON DEVICE AND JET PROPELLED WATERCRAFT

CROSS REFERENCE TO RELATED APPLICATIONS

This application claims the benefit of priority to Japanese Patent Application No. 2022-114011 filed on Jul. 15, 2022. The entire contents of this application are hereby incorporated herein by reference.

BACKGROUND OF THE INVENTION

1. Field of the Invention

The present invention relates to a sponson device and a jet propelled watercraft.

2. Description of the Related Art

There has been conventionally known a jet propelled watercraft provided with front fins on both lateral sides of a front portion of a watercraft body (see Japan Laid-open Patent Application Publication No. 2001-233288). The front fins submerge when the watercraft body is tilted by abrupt turning of the jet propelled watercraft such that the watercraft body is inhibited from tilting at a larger bank angle, and while being inhibited from being trimmed by the bow. The front fins are fixed to the watercraft body by bolts.

In the jet propelled watercraft disclosed in Japan Laid-open Patent Application Publication No. 2001-233288, the front fins are fixed at constant positions to the watercraft body. Thus, the trim of the watercraft body cannot be adjusted during turning of the jet propelled watercraft depending on user preferences and/or usage situations.

SUMMARY OF THE INVENTION

Preferred embodiments of the present invention provide sponson devices by which adjustment of a trim of a body of a watercraft is enabled during turning of the watercraft depending on user preferences and/or usage situations.

A sponson device according to a preferred embodiment of the present invention is attachable to a watercraft body of a jet propelled watercraft. The sponson device includes a bow sponson located forward of a center of gravity of the watercraft body, protrudes from the watercraft body in a right-and-left direction, and is movable to a first position and a second position to adjust a trim of the watercraft body during turning of the jet propelled watercraft.

A jet propelled watercraft according to another preferred embodiment of the present invention includes a watercraft body and a sponson device attached to the watercraft body. The sponson device includes a bow sponson to adjust a trim of the watercraft body during turning of the jet propelled watercraft. The bow sponson is located forward of a center of gravity of the watercraft body, protrudes from the watercraft body in a right-and-left direction, and is movable to a first position and a second position.

In the sponson device and the jet propelled watercraft according to preferred embodiments of the present invention, the bow sponson is movable to the first position and the second position. Accordingly, adjustment of the position of the bow sponson is enabled and, thus, adjustment the trim of the watercraft body is enabled during turning of the jet propelled watercraft depending on user preferences and/or usage situations.

According to preferred embodiment of the present invention, it is possible to provide a sponson device by which adjustment of the trim of a body of a watercraft is enabled during turning of the watercraft depending on user preferences and/or usage situations.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
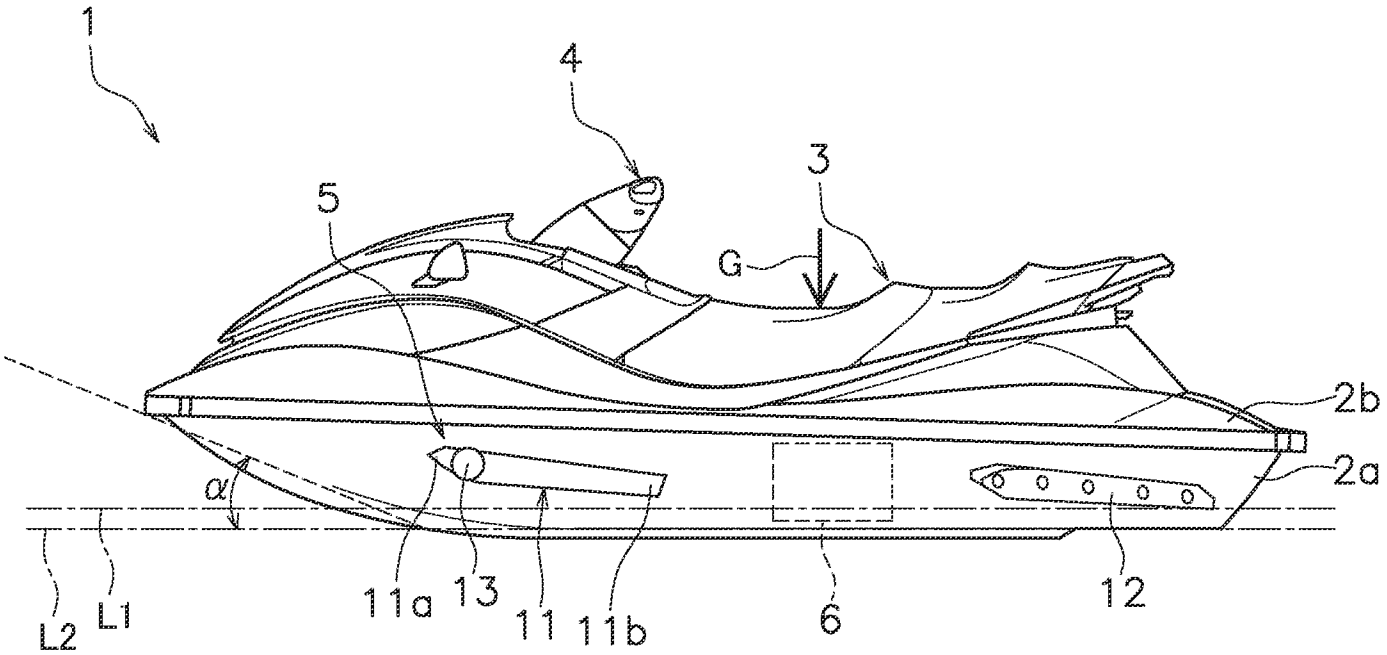
FIG. 1 is a left side view of a jet propelled watercraft.

Preferred embodiments of the present invention will be hereinafter explained with reference to the drawings. FIG. 1 is a left side view of a jet propelled watercraft 1 according to a preferred embodiment of the present invention. The jet propelled watercraft 1 is a so-called personal watercraft (PWC). It should be noted that in the following explanation, terms indicating such directions as "back and forth", "right and left", and "up and down" are explained based on the jet propelled watercraft 1.

The jet propelled watercraft 1 includes a watercraft body 2, a seat 3, a handle 4, and a sponson device 5.

The watercraft body 2 includes a hull 2*a* and a deck 2*b*. The hull 2*a*, provided as a lower portion of the watercraft body 2, is contact with the water during operation. The deck 2*b*, provided as an upper portion of the watercraft body 2, is located on top of the hull 2*a*.

The watercraft body 2 includes components such as an engine 6 and a fuel tank (not shown in the drawings) in the interior thereof. A jet propulsion mechanism (not shown in the drawings) is disposed in a rear lower portion of the watercraft body 2. The jet propulsion mechanism has a heretofore known configuration and generates a thrust to propel the watercraft body 2 by a drive force generated by the engine 6. The jet propulsion mechanism jets water sucked in from the bottom of the jet propelled watercraft 1 so as to generate the thrust to propel the watercraft body 2. The jet propulsion mechanism is configured to change the direction of water jetted therefrom in accordance with operation of the handle 4.

The seat 3 is attached to the deck 2*b*. The seat 3 is disposed directly above the engine 6. The seat 3 is a component on which a user is seated, and the watercraft body 2 is configured such that the center of gravity (G) thereof is located at a portion of the seat 3. It should be noted that the watercraft body 2 may be configured such that the center of gravity G thereof is located in an installation position of the engine 6.

The handle 4 is a component to steer the watercraft body 2 and is disposed directly in front of the seat 3. The handle 4 is provided with an operating portion (not shown in the drawings) to regulate an output of the engine 6.

Figure 2:
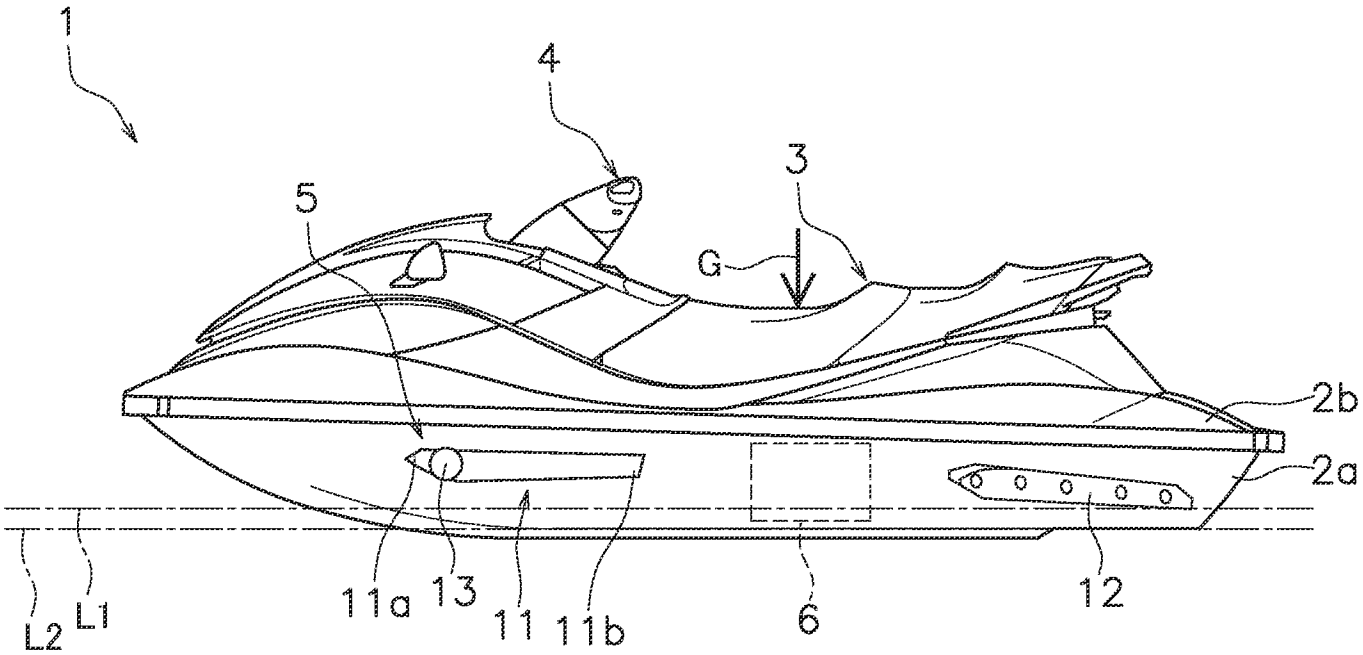
FIG. 2 is a left side view of the jet propelled watercraft.
Figure 3:
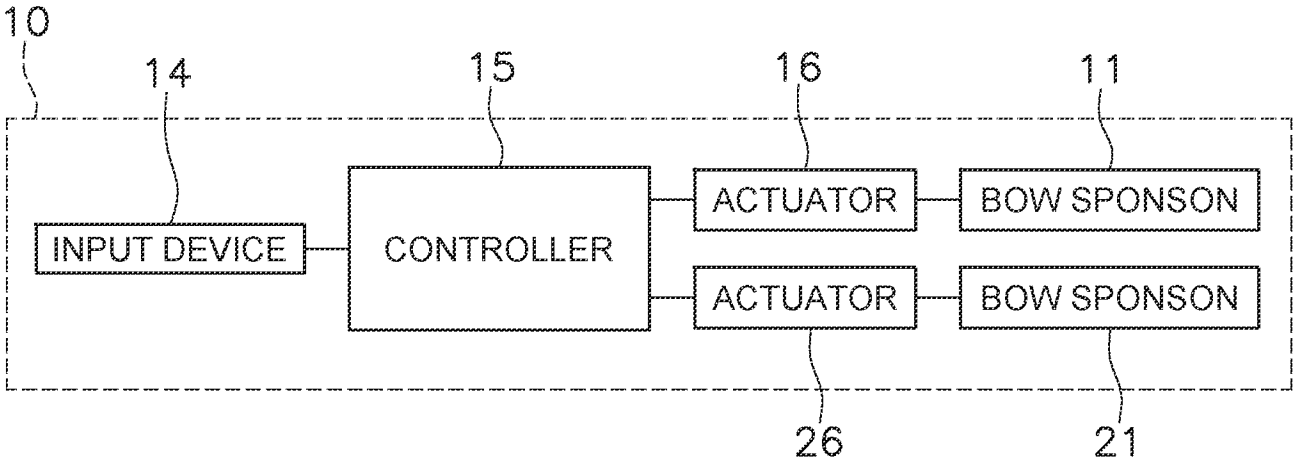
FIG. 3 is a block diagram showing a control system for a sponson device.

The sponson device 5 is attached to the watercraft body 2. As shown in FIGS. 1 to 3, the sponson device 5 includes a bow sponson 11, a rear sponson 12, a shaft member 13, an input device 14, a controller 15, and an actuator 16.

The bow sponson 11 is preferably made of a resin material, for example. The bow sponson 11 adjusts the trim of the watercraft body 2 during left turning of the jet propelled watercraft 1. The bow sponson 11 is at least partially submerged during the left turning. Accordingly, adjustment of the trim of the watercraft body 2 is performed. In the present specification, the term "trim" refers to an angle α of the bow of the jet propelled watercraft 1, where a waterline L (the surface of water) is set as 0 degrees. It should be noted that the angle α shown in FIG. 1 exemplifies an angle of the bow, where a waterline L2 in straight planing of the jet propelled watercraft 1 is set as 0 degrees.

The bow sponson 11 protrudes from the watercraft body 2 in the right-and-left direction. The bow sponson 11 protrudes leftward from a left lateral portion of the hull 2*a* of the watercraft body 2. The bow sponson 11 is located forward of the center of gravity G of the watercraft body 2. The bow sponson 11 is located above a waterline L1 during standstill of the watercraft body 2. The bow sponson 11 is located above the waterline L2 during straight planing of the jet propelled watercraft 1. In other words, the bow sponson 11 is entirely exposed from the surface of water during the straight planing of the jet propelled watercraft 1. It should be noted that the bow sponson 11 may be located below the waterline L1 during the standstill of the watercraft body 2, or alternatively, may contact the surface of water during the standstill of the watercraft body 2.

The bow sponson 11 extends in the back-and-forth direction. The lower end of the bow sponson 11 is straight or substantially straight. A front end 11*a* of the bow sponson 11 is located forward of the handle 4. A rear end 11*b* of the bow sponson 11 is located rearward of the handle 4. The rear end lib of the bow sponson 11 is located forward of the seat 3. It should be noted that the rear end lib of the bow sponson 11 may be located forward of the handle 4.

The bow sponson 11 is be movable to a first position shown in FIG. 1 and a second position shown in FIG. 2. In the present preferred embodiment, the bow sponson 11 pivots about the axis of the shaft member 13 between the first position and the second position.

When in the first position, the bow sponson 11 tilts with respect to the back-and-forth direction of the watercraft body 2 in the side view. When in the second position, the bow sponson 11 is parallel or substantially parallel to the back-and-forth direction of the watercraft body 2 in the side view. When the bow sponson 11 is in the first position, the rear end 11*b* thereof is located below the rear end 11*b* thereof when the bow sponson 11 is in the second position. When the bow sponson 11 is in the first position, the front end 11*a* thereof is located above the front end 11 thereof when the bow sponson 11 is in the second position. When the bow sponson 11 is in the first position, the rear end 11*b* thereof is located below the shaft member 13.

The rear sponson 12 is preferably made of a resin material, for example. The rear sponson 12 is located rearward of the center of gravity G of the watercraft body 2. The rear sponson 12 is located rearward of the seat 3. The rear sponson 12 is at least partially above the waterline L1 during the standstill of the watercraft body 2. The rear sponson 12 is disposed at least partially above the waterline L2 during the straight planing of the jet propelled watercraft 1. In the present preferred embodiment, the rear sponson 12 is entirely located above the waterline L2 during the straight planing of the jet propelled watercraft 1. It should be noted that the rear sponson 12 may be disposed at least partially lower than the waterline L2 during the straight planing of the jet propelled watercraft 1, or alternatively, may contact the surface of water during the straight planing of the jet propelled watercraft 1.

The rear sponson 12 protrudes from the watercraft body 2 in the right-and-left direction. The rear sponson 12 protrudes leftward from the left lateral portion of the hull 2*a* of the watercraft body 2. The rear sponson 12 is fixed to the hull 2*a* of the watercraft body 2 by, for example, a plurality of bolts and a plurality of nuts.

The rear sponson 12 extends in the back-and-forth direction. The lower end of the rear sponson 12 is substantially straight. The rear end of the rear sponson 12 is located lower than the front end thereof. The lower end of the rear sponson 12 is located lower than that of the bow sponson 11. In other words, the bow sponson 11 is entirely located above the lower end of the rear sponson 12.

The shaft member 13 is supported by the hull 2*a* of the watercraft body 2. The shaft member 13 supports the bow sponson 11 such that the bow sponson 11 is pivotable. The shaft member 13 extends in the right-and-left direction of the watercraft body 2. The shaft member 13 is located forward of the handle 4. The shaft member 13 is located above the lower end of the rear sponson 12.

The input device 14 is operable by the user and outputs a signal indicating operation of the input device 14 to the controller 15. The user is able to select either the first position or the second position as the position of the bow sponson 11 by operating the input device 14. The input device 14 is a pressable switch, for instance, and is disposed in the vicinity of a grip of the handle 4. The input device 14 may be of another type such as a dial type, a slide type, or a touchscreen type.

The controller 15 includes a processor such as a CPU (Central Processing Unit) and memories such as a RAM (Random Access Memory) and a ROM (Read Only Memory). The controller 15 controls the actuator 16 in accordance with the signal outputted from the input device 14 such that the bow sponson 11 is moved from either one of the first and second positions to the other of the first and second positions.

The actuator 16 causes the bow sponson 11 to move to the first position and the second position. The actuator 16 causes the bow sponson 11 to pivot about the axis of the shaft member 13 between the first position and the second position. The actuator 16 may include a servomotor or a cylinder and is controlled by the controller 15.

Figure 4:
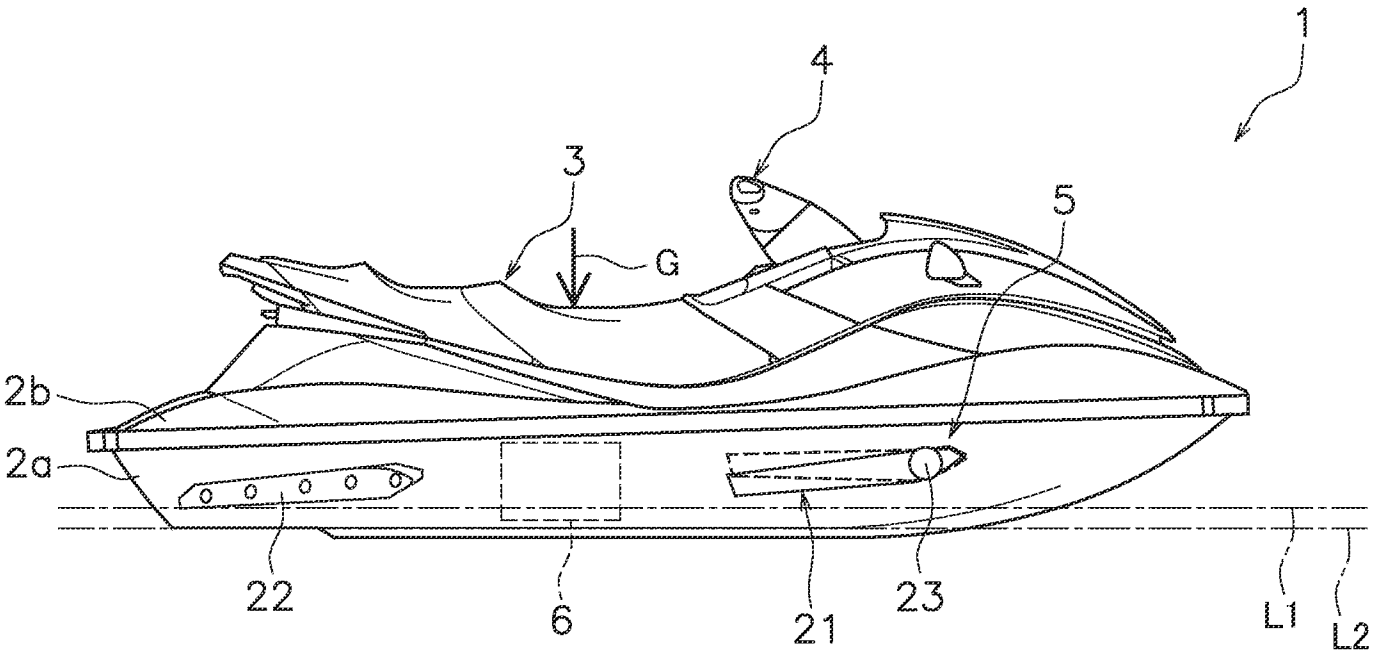
FIG. 4 is a right side view of the jet propelled watercraft.

As shown in FIGS. 3 and 4, the sponson device 5 includes a bow sponson 21, a rear sponson 22, a shaft member 23, and an actuator 26.

The bow sponson 21 is shaped bilaterally symmetric to the bow sponson 11 and is configured in a comparable manner to the bow sponson 21. In other words, the bow sponson 21 is movable to the first position and the second position in a comparable manner to the bow sponson 11. The bow sponson 21 adjusts the trim of the watercraft body 2 during right turning of the jet propelled watercraft 1. The rear sponson 22 is shaped bilaterally symmetric to the rear sponson 12 and is configured in a comparable manner to the rear sponson 12. The shaft member 23 is shaped bilaterally symmetric to the shaft member 13 and is configured in a comparable manner to the shaft member 13.

The actuator 26 is configured in a comparable manner to the actuator 16 and causes the bow sponson 21 to move to the first position and the second position. The actuator 26 causes the bow sponson 21 to pivot about the axis of the shaft member 23 between the first position and the second position. The controller 15 controls the actuator 26 in accordance with the signal outputted from the input device 14 such that the bow sponson 21 is moved from either one of the first and second positions to the other of the first and second positions.

In the present preferred embodiment, the controller 15 controls the actuators 16 and 26 in accordance with the signal outputted from the input device 14 such that the bow sponsons 11 and 21 have equal or substantially equal tilt angles with respect to the watercraft body 2.

Figure 5:
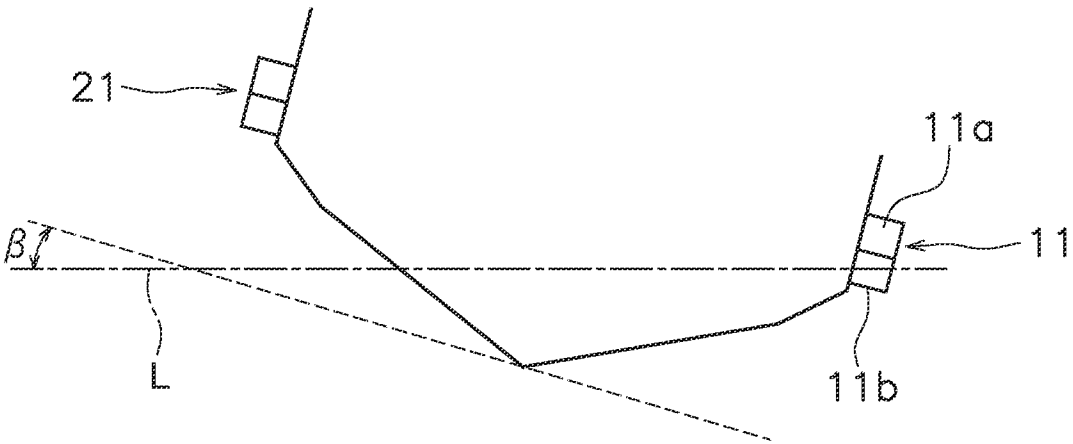
FIG. 5 is a diagram for explaining a relationship between a bow sponson and a surface of water during turning of the jet propelled watercraft.
Figure 6:
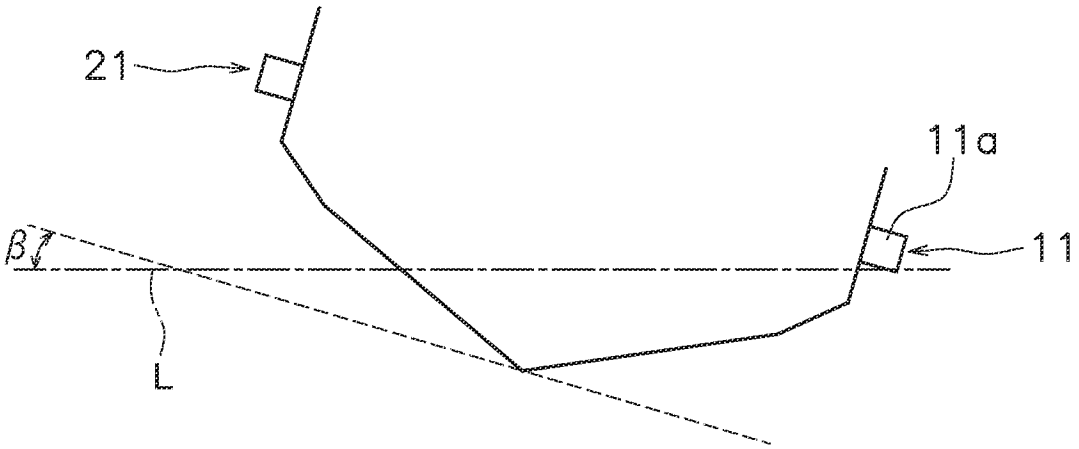
FIG. 6 is a diagram for explaining a relationship between the bow sponson and the surface of water during turning of the jet propelled watercraft.

FIGS. 5 and 6 are schematic diagrams of the bow sponsons 11 and 21 seen from the front side during left turning of the jet propelled watercraft 1. Each bow sponson 11, 21 is in the first position in FIG. 5, whereas each bow sponson 11, 21 is in the second position in FIG. 6. When in the first position during the left turning, the bow sponson 11 is more likely to contact the water than when in the second position. Because of this, during the left turning, when the bow sponson 11 is in the first position, the watercraft body 2 has a more reduced bank angle β and is more trimmed by the stern (has an increased angle α of the bow) than when the bow sponson 11 is in the second position. In this case, the watercraft body 2 has a reduced amount of behavior or maneuverability. Thus, the user is able to have a comfortable ride.

On the other hand, during left turning of the jet propelled watercraft 1, when in the second position, the bow sponson 11 is more unlikely to contact the water than when in the first position. In other words, when in the second position, trim adjustment by the bow sponson 11 is less effective than when in the first position. Because of this, during the left turning, when the bow sponson 11 is in the second position, the watercraft body 2 is has an increased bank angle β and is more trimmed by the bow (has a reduced angle α of the bow) than when the bow sponson 11 is in the first position. Because of this, when the bow sponson 11 is in the second position, the watercraft body 2 becomes more likely to tilt than when the bow sponson 11 is in the first position. Thus, the watercraft body 2 has an increased amount of behavior or maneuverability such that the jet propelled watercraft 1 is able to turn quickly. It should be noted that during right turning of the jet propelled watercraft 1, advantageous effects comparable to those achieved by the bow sponson 11 are achieved depending on the position of the bow sponson 21.

In the sponson device 5 and the jet propelled watercraft 1 according to the present preferred embodiment, each bow sponson 11, 21 is movable to the first position and the second position. Accordingly, adjustment of the position of each bow sponson 11, 21 is enabled. Thus, adjustment of the trim of the watercraft body 2 is enabled during turning of the jet propelled watercraft 1 depending on user preferences and/or usage situations. Adjustment of the position of each bow sponson 11, 21 is enabled regardless of operation of the handle 4. Thus, the sponson device 5 is prevented from having a complicated structure. Each bow sponson 11, 21 is located above the waterline L2 during the straight planing of the jet propelled watercraft 1. Thus, each bow sponson 11, 21 is unlikely to contact the water during the straight planing.

Preferred embodiments of the present invention have been explained above. However, the present invention is not limited to the preferred embodiments described above, and a variety of changes can be made without departing from the gist of the present invention.

Each bow sponson 11, 21 may be configured to be adjustable to an arbitrary position located between the first position and the second position. Each bow sponson 11, 21 may be configured to be entirely moved in the up-and-down direction so as to be adjusted in its position. The first and second positions of each bow sponson 11, 21 may be different from those in the preferred embodiments described above. For example, when in the second position, each bow sponson 11, 21 may tilt with respect to the back-and-forth direction of the watercraft body 2 in the side view. Each rear sponson 12, 22 may be omitted.

The bow sponsons 11 and 21 may be configured to be controlled independently of each other by the controller 15. For example, the bow sponsons 11 and 21 may be configured to be controlled to tilt at different angles from each other with respect to the watercraft body 2. In this case, the input device 14 may include a first switch to adjust the position of the bow sponson 11 and a second switch to adjust the position of the bow sponson 21.

The second position of the bow sponson 11 may be set to prevent the bow sponson 11 from submerging during the left turning. Likewise, the second position of the bow sponson 21 may be set to prevent the bow sponson 21 from submerging during the right turning.

As long as each bow sponson 11, 21 is movable to the first position and the second position, each bow sponson 11, 21 may be configured in an arbitrary manner. Each bow sponson 11, 21 may be movable to the first position and the second position by a mechanical structure. For example, each bow sponson 11, 21 may be configured to be detachably attached to the watercraft body 2 through a fixing member such as a bolt so as to be fixed in either the first or second position.

Each shaft member 13, 23 may extend in the back-and-forth direction of the watercraft body 2. In this case, for instance, adjustment of the position of the bow sponson 11 may be made by causing the bow sponson 11 to pivot about the shaft member 13 such that the left end thereof is entirely moved in the up-and-down direction.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A sponson device attachable to a watercraft body of a jet propelled watercraft, the sponson device comprising:

a bow sponson located forward of a center of gravity of the watercraft body; wherein the bow sponson protrudes from the watercraft body in a right-and-left direction, and is movable to a first position and a second position to adjust a trim of the watercraft body during turning of the jet propelled watercraft.

2. The sponson device according to claim 1, wherein the bow sponson is above a waterline during straight planing of the jet propelled watercraft.

3. The sponson device according to claim 1, wherein the bow sponson is at least partially submerged during the turning of the jet propelled watercraft.

4. The sponson device according to claim 1, further comprising:

a shaft supported by the watercraft body; wherein the bow sponson is pivotable about an axis of the shaft between the first position and the second position.

5. The sponson device according to claim 4, wherein the shaft extends in the right-and-left direction of the watercraft body.

6. The sponson device according to claim 5, wherein, when the bow sponson is in the first position, a rear end thereof is located lower than when the bow sponson is in the second position.

7. The sponson device according to claim 4, further comprising:

a rear sponson located rearward of the center of gravity of the watercraft body; wherein the rear sponson protrudes from the watercraft body in the right-and-left direction; and the shaft is located above a lower end of the rear sponson.

8. The sponson device according to claim 5, wherein the shaft is located forward of a handle of the jet propelled watercraft.

9. The sponson device according to claim 1, wherein a rear end of the bow sponson is located rearward of a handle of the jet propelled watercraft.

10. The sponson device according to claim 9, wherein the rear end of the bow sponson is located forward of a seat of the jet propelled watercraft.

11. The sponson device according to claim 1, further comprising:

an input operable by a user;

an actuator to cause the bow sponson to move to the first position and to the second position; and a controller configured or programmed to control the actuator in accordance with a signal outputted from the input.

12. A jet propelled watercraft comprising:

a watercraft body; and a sponson device attached to the watercraft body; wherein the sponson device includes a bow sponson to adjust a trim of the watercraft body during turning of the jet propelled watercraft; and the bow sponson is located forward of a center of gravity of the watercraft body, protrudes from the watercraft body in a right-and-left direction, and is movable to a first position and a second position.

* * * * *